US005088755A

United States Patent [19]

Jodelet

[11] Patent Number: 5,088,755

[45] Date of Patent: Feb. 18, 1992

[54] SNOW SKI, PROCEDURE FOR ITS MANUFACTURE AND DEVICE FOR THE IMPLEMENTATION OF THIS PROCEDURE

[75] Inventor: Francois Jodelet, Voiron, France

[73] Assignee: Skis Rossignol S.A., Voiron, France

[21] Appl. No.: 580,528

[22] Filed: Sep. 11, 1990

[30] Foreign Application Priority Data

Sep. 29, 1989 [FR] France ..... 89 13228

[51] Int. Cl.[5] ..... B27M 3/00; A63C 5/04

[52] U.S. Cl. ..... 280/609; 144/144 A; 144/220; 144/240; 144/259; 144/269; 144/270; 144/372; 144/144.5 R; 280/601; 409/108; 409/118

[58] Field of Search ..... 144/144 R, 144 A, 144.5, 144/220, 240, 259, 269, 270, 372, 2 R; 409/108, 118; 269/268; 280/601, 609

[56] References Cited

U.S. PATENT DOCUMENTS

| | | | |
|---|---|---|---|
| 881,793 | 3/1908 | Green | 144/144 R |
| 2,851,071 | 9/1958 | Schils | 144/144 R |
| 3,165,976 | 1/1965 | Haspel | 409/118 |
| 4,077,449 | 3/1978 | Helmes | 144/144 A |

FOREIGN PATENT DOCUMENTS

| | | | |
|---|---|---|---|
| 1066428 | 1/1954 | France | 144/144 R |
| 402462 | 8/1971 | U.S.S.R. | 144/144 R |

*Primary Examiner*—W. Donald Bray
*Attorney, Agent, or Firm*—Oliff & Berridge

[57] ABSTRACT

This snow ski, the sides of which have an inclination which is variable in relation to the plane of the sole of the ski, at different points along its length, and are constituted by curved convex or concave lines, in which the profiles of the sides are of variable curvature according to the cross-section in question of the ski.

A procedure for manufacturing this ski consists, starting from a rough ski, in carrying out the machining of the lateral parts of the ski with the aid of a rotary tool with an axis perpendicular to the plane of the upper surface of the ski, the active surface of which is generated by a continuous monotonic curve, by carrying out a relative movement of the tool and of the ski simultaneously, in the direction of the length of the ski, in the direction of the width of the ski and in a direction perpendicular to the plane of the upper surface of the ski.

8 Claims, 3 Drawing Sheets

SNOW SKI, PROCEDURE FOR ITS MANUFACTURE AND DEVICE FOR THE IMPLEMENTATION OF THIS PROCEDURE

The present invention relates to a snow ski, a procedure for its manufacture and a device for the implementation of this procedure.

BACKGROUND OF THE INVENTION

Most often, a ski has a rectangular cross-section, the lower surface of which is delimited by the sliding sole, the upper surface of which is delimited by a serigraphed covering wall, and the two lateral faces of which are delimited by sides. At the junction line between the sole and the sides, metal edges are arranged, which make it possible to improve the guiding conditions and the holding on hard snow and on ice.

It is also known to produce skis, the sides of which are not perpendicular to the lower surface and to the upper surface, but inclined so as to form, over at least a part of the length of the ski, an acute angle with the lower sole. At the ends of the ski—tip and heel—this angle can have a value which is lower than that which is found in the area of the runner. Such an arrangement makes it possible to permit skiing in powdery snow, since the ends of the ski "cut through" the snow better than in the case of a ski which is of rectangular cross-section over its entire length.

Seen in transverse cross-section, skis with inclined sides generally have inclined rectilinear parts, possibly concave or convex, in the area of the sides.

The object of the present invention is to provide a ski with inclined sides, in which the profiles of the inclined zones of the sides, which are constituted by curved convex or concave lines, have a variable curvature along the ski.

Such a structure makes it possible to influence the mechanical characteristics of the ski, its esthetic quality and the resistance to wear of the upper edges.

However, skis with inclined sides present production difficulties. A ski with inclined sides can be obtained directly by molding in a shaped mold. In such a case, it is appropriate to have available equipment which is costly and difficult to implement for certain structures.

It is also conceivable to produce a ski with inclined sides by machining the sides with the aid of a numerically controlled machine tool. However, in order to produce special shapes, and in particular curved surfaces, it is appropriate to have available a fourspindle machine, with a cylindrical milling cutter, which requires a major investment. It would also be possible to carry out machining with the aid of a machine tool with three spindles, with a shaped milling cutter.

SUMMARY OF THE INVENTION

The object of the present invention is to remedy these disadvantages by providing a procedure and a device which make it possible to obtain, by machining, a snow ski, the sides of which have an inclination which is variable in relation to the plane of the sole of the ski, at different points along its length, and are constituted by curved convex or concave lines, the profiles of the sides having a variable curvature according to the cross-section in question of the ski.

To this end, the procedure for manufacturing a ski to which it relates consists, starting from a rough ski, in carrying out the machining of the lateral parts of the ski with the aid of a rotary tool with an axis perpendicular to the plane of the upper surface of the ski, the active surface of which is generated by a continuous monotonic curve, by carrying out a relative movement of the tool and of the ski simultaneously, in the direction of the length of the ski, in the direction of the width of the ski and in a direction perpendicular to the plane of the upper surface of the ski.

Adjustment of the depth of cut in the direction of the width of the ski makes it possible to give it the desired profile. According to the position of the tool with regard to the length of the ski, this depth of cut varies.

The relative movement of the tool and of the ski, perpendicular to the plane of the upper surface of the latter, makes it possible to vary the inclination of the sides and the radius of curvature of these. In fact, according to the position of the side of the ski in relation to the active part of the tool, machining is carried out at a greater or smaller angle in relation to the plane of the sole and to the plane of the upper surface of the ski.

It is therefore a simple method which makes it possible to bring about a variable inclination of the sides over the length of the ski.

It is to be noted that the curvature of the side can be constant over the entire length of the ski insofar as the generating line of the surface of revolution of the tool is a circular arc, or variable along the ski insofar as the generating line is itself produced from a number of successive sections of curves, which are described starting from mathematical formulas which are different from one another.

According to a simple method of implementation, this procedure consists in carrying out a relative movement of the ski and of the tool in the direction of the length of the ski, by displacement of the ski longitudinally in relation to the tool, a relative movement in the direction of the width of the ski, by displacement of the tool in relation to the ski, and a relative movement in a direction perpendicular to the plane of the ski, by deformation of the ski by bending, during the machining operation.

A device for the implementation of this procedure comprises means of positioning and of clamping the ski to be machined and means of displacement of the ski longitudinally in relation to the tool and of guiding the tool with the aid of a template in the direction of the width of the ski.

According to an advantageous characteristic of the invention, the ski to be machined is shaped in the direction perpendicular to the plane of its upper surface, by support and clamping in a cradle.

It is interesting to note that, in such a case, the variation of the curvature of each side of the ski over the length of the latter is obtained by relative displacement of the inclined side of the ski in relation to the tool, in a plane perpendicular to the plane of the upper surface of the ski, which results from the shaping of the ski in its cradle.

BRIEF DESCRIPTION OF THE DRAWINGS

The invention will in any case be clearly understood with the aid of the description below, with reference to the attached schematic drawings which represent, by way of non-limitative example, an embodiment of this ski as well as an embodiment of means which allow the inclined sides thereof to be obtained.

Figure 1:
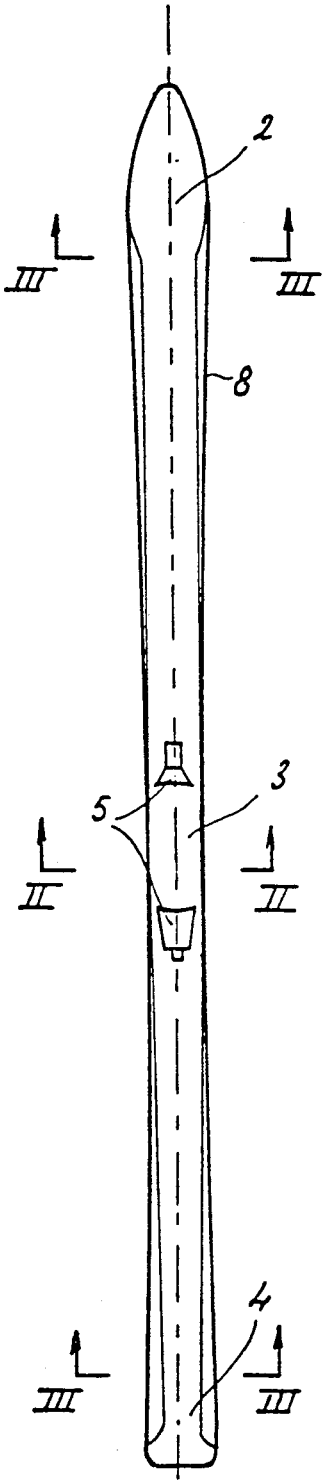
FIG. 1 is a view from above of a ski according to the invention.
Figure 2:
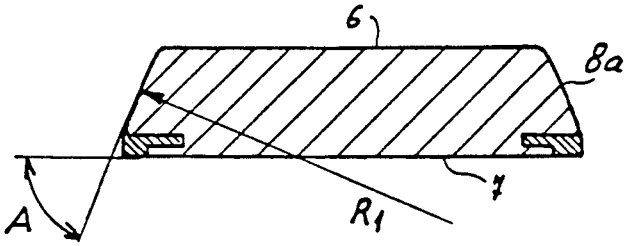
FIGS. 2 and 3 are two views of the same in transverse cross-section and on enlarged scale, along the lines II—II and III—III in FIG. 1.
Figure 3:
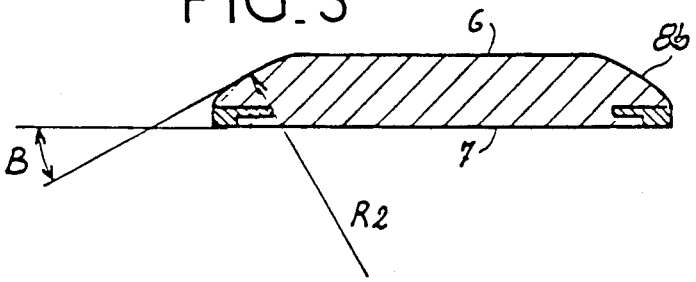

The ski represented in FIG. 1 is an alpine ski which has a tip 2, a runner 3 and a heel zone 4. On the upper surface of the ski, in the central part of the latter, fixings 5 for a ski boot are mounted. The ski according to the invention comprises sides, that is to say lateral surfaces which connect the upper surface 6 and the lower surface 7, which are not perpendicular to these two surfaces as is conventionally the case, but which are inclined, this inclination being variable along the ski. It is thus that in the runner zone, each side 8*a* forms, as shown in FIG. 2, an angle A of less than 90° with the sole 7, whereas, close to the tip 2 and to the heel 4, each side 8*b* forms, as shown in FIG. 3, an angle B with the sole 7, the value of the angle B being lower than that of the angle A. As can also be seen from the drawings, the sides 8 are not constituted by flat surfaces but have, seen in transverse cross-section, a curved profile, convex in this case, corresponding to radiuses of curvature R1 in the runner zone and R2 in the tip and heel zones respectively.

Figure 4:
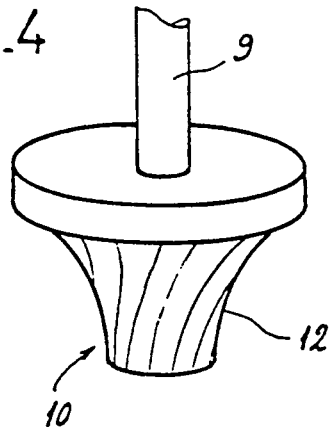
FIG. 4 is a perspective view of a tool for machining this ski.

The ski according to the invention is obtained starting from a rough product of essentially rectangular cross-section, that is to say the sides of which are essentially perpendicular to the upper surface 6 and to the lower surface 7. The ski itself is produced by machining the rough product, with the aid of a tool which is represented in greater detail in FIG. 4. This tool comprises a shaft 9, at the end of which is mounted an active part 10 which has a concave surface of revolution 12, this surface of revolution being generated by a generating line which is itself concave and which can be constituted either by a circular arc or by a complex curve, the curvature of which is variable.

According to the essential characteristic of the procedure according to the invention, the variation of the inclination of the sides of the ski is obtained by carrying out relative displacements of each tool and of the ski:

a longitudinal displacement of the ski in relation to each tool, a lateral displacement of each tool in relation to the ski, a relative displacement of each tool and of the upper plane of the ski, perpendicularly to the plane of the ski.

Figure 5:
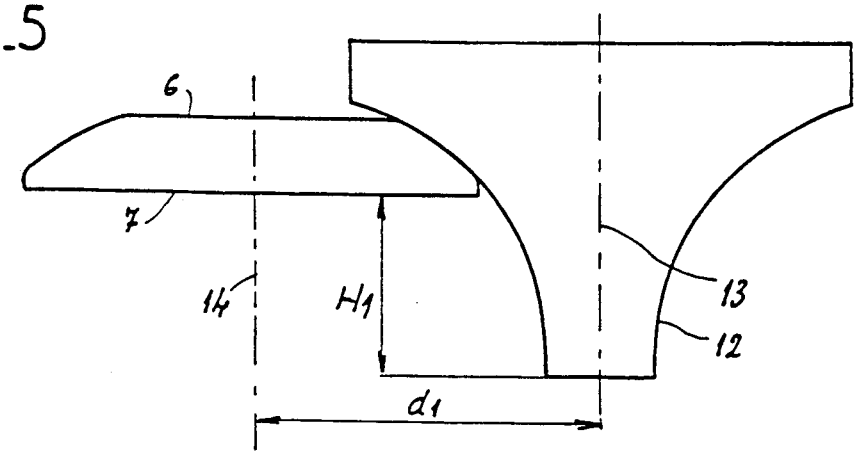
FIGS. 5 to 7 are three side views which represent the tool and the ski during three stages of machining, respectively at the front of the ski, in the runner zone of the latter and close to its heel.
Figure 6:
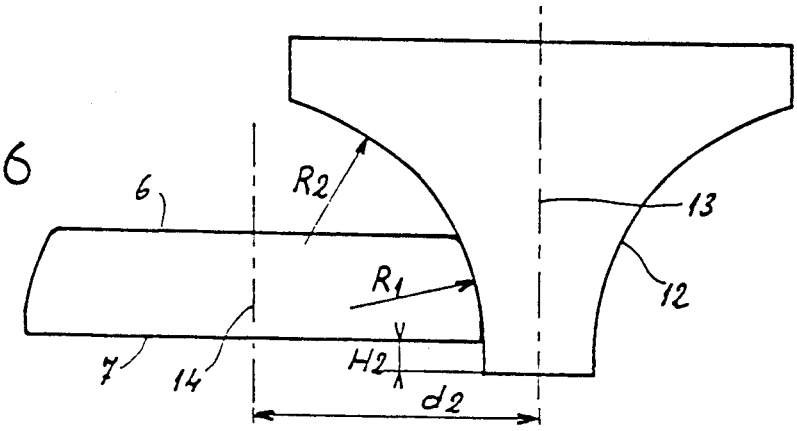
Figure 7:
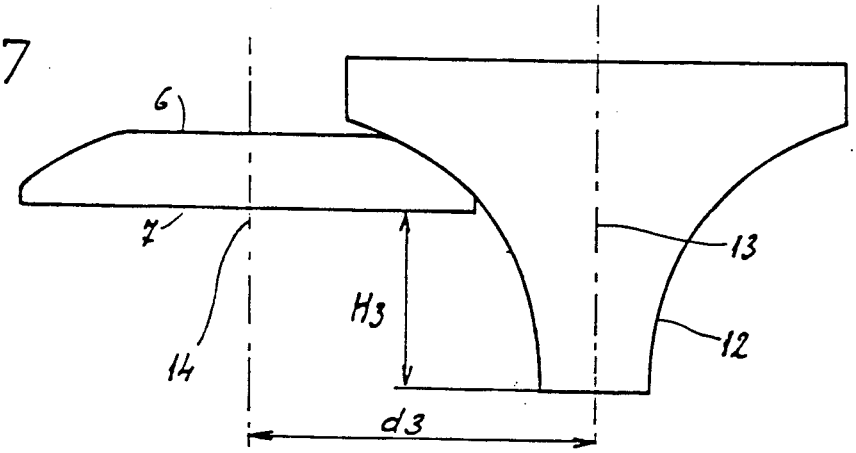

FIGS. 5 to 7 represent three positions of the ski in relation to the tool, in a zone close to the tip, in the runner zone and close to the heel respectively.

As can be seen from the drawings, the distance between the lower surface of the ski and the base of the tool has relatively large values H1 and H3 in the zones close to the tip and to the heel. The result of this is that the ski is in contact with the upper part of the active surface of the tool, that is to say that part of the active surface which is relatively slightly inclined in relation to the horizontal.

By contrast, in the runner zone, as shown in FIG. 6, the lower surface of the ski is at a relatively small distance H2 from the base of the tool, so that the side of the rough product is in contact with a part of the active surface of the tool which is relatively close to the vertical.

It is also possible to act upon the depth of cut, by adapting the transverse displacement of the tool in relation to the ski. Taking the shape of the ski into account, the distance d2 between the longitudinal central axis of the ski and the axis of the tool is smaller in the runner zone, as shown in FIG. 6, than the corresponding distances d1 and d3, FIGS. 5 and 7, in the tip and heel zones.

Figure 8:
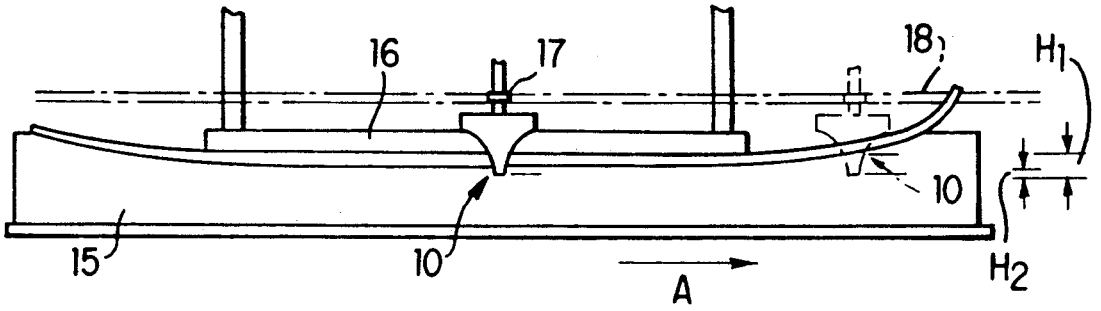
FIG. 8 is a very schematic side view of means which permit the machining of the ski.
Figure 9:
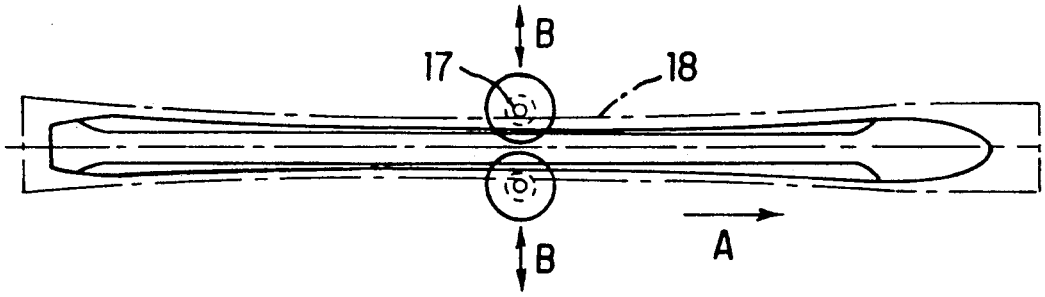
FIG. 9 is a view from above of a ski in the course of machining.

FIGS. 8 and 9 represent means for the implementation of this procedure.

FIG. 8 shows more particularly a cradle 15, which is recessed, in which a ski is mounted and kept in position by clamping by support shoes 16. The result of this structure is that, taking into account the bend which is imparted to the ski, there is brought about, at the time of the longitudinal displacement of the cradle in the direction of arrow A, a relative displacement, in the direction of the height, of each tool 10 and of the upper plane of the ski. As the bowed cradle mounted ski is moved in the direction of arrow A, the tool's position is relatively moved from that shown in dotted lines to that shown in solid lines and thence to the end or heel of the ski. In the process, the relative height of engagement of the ski's lateral side and tool 10 changes as shown in FIGS. 5–8.

FIG. 9 shows a ski in a view from above, in the course of machining, the transverse displacement of each tool being brought about by means of a guiding roller 17 which is mounted on the axis of the tool, in the directions of arrows B, and bears against a template 18 (shown in dash-dot lines), the copying of which makes it possible to obtain, above the edges, the profile of the lateral parts of the ski.

As can be seen from the above, the invention brings a great improvement to the existing art, by providing a ski with interesting structure, obtained by means of a simple and inexpensive implementation procedure and device.

It is possible to work with the aid of standard equipment, namely a shaping machine with one or two machining heads and a dual-function template or two independent templates to carry out the positioning of the ski in relation to the height of the tool and the copying of the profile of the lateral parts of the ski respectively.

The invention is of course not limited to the single embodiment of this ski, which is described above by way of example, or to the single method of implementation of its manufacturing procedure, but on the contrary includes all the alternatives. In particular it is thus that the inclined surfaces could be concave rather than convex, that the tools arranged on one side and the other of the ski could have a different profile for the purpose of obtaining a ski with a dissymmetrical profile, or indeed that the ski could be fixed and each tool displaceable longitudinally without, however, leaving the scope of the invention.

I claim:

1. A snow ski, comprising:

an upper surface;

a sole; and sides which have an inclination that is variable in relation to a plane of the sole of the ski along a length of the ski, a profile of the sides having a variable curvature according to a position of the profile along the length of the ski.

2. A ski as claimed in claim 1, wherein said inclination along the length of the ski varies from a point proximate a toe of the ski to a point proximate a heel of the ski.

3. A ski as claimed in claim 2, wherein said profile is defined by one of a group of profiles consisting of convex lines and concave lines.

4. A procedure for manufacturing a ski having sides which have an inclination that is variable in relation to a plane of a sole of the ski along a length of the ski, which comprises the steps of:

positioning and clamping a rough ski in a mount;

machining the lateral parts of the ski with the aid of a rotary took having a rotary axis substantially perpendicular to a plane of the upper surface of the ski and an active surface which is generated by a continuous monotonic curve, the machining being carried out by a relative movement of the tool and of the ski simultaneously in a direction of the length of the ski, in a direction of a width of the ski and in a direction substantially perpendicular to the plane of the upper surface of the ski.

5. The procedure as claimed in claim 4, wherein the relative movement of the ski and of the tool in the direction of the length of the ski is by displacement of the ski longitudinally in relation to the tool, the relative movement in the direction of the width of the ski is by displacement of the tool transverse to the length of the ski but substantially parallel to the plane of the upper surface of the ski, and the relative movement in a direction substantially perpendicular to the plane of the upper surface of the ski results from deformation of the ski by bending produced by a concave upper surface of the mount during the machining operation.

6. A device for machining a ski having sides which have an inclination that is variable in relation to a plane of a sole of the ski along a length of the ski, which comprises:

at least one rotary cutting tool;

means for positioning and clamping the ski to be machined to provide displacement of the ski along a length of the ski relative to a cutting surface of the rotary cutting tool;

means for displacement of the ski longitudinally in relation to the rotary cutting tool; and a template for guiding the rotary cutting tool in the direction of the width of a ski.

7. The device as claimed in claim 6, wherein the means for positioning and clamping the rough ski is a cradle having a concave upper surface.

8. A device for machining a ski as claimed in claim 6, wherein said at least one rotary cutting tool has a cutting surface defined by a continuous monotonic curve, a rotary axis of said rotary cutting tool being substantially perpendicular to a plane of the sole of the ski.

* * * * *